US011927421B1

(12) United States Patent
Watts

(10) Patent No.: US 11,927,421 B1
(45) Date of Patent: Mar. 12, 2024

(54) LONG BOW WITH TENSIONERS

(71) Applicant: Titus Gadwin Watts, San Francisco, CA (US)

(72) Inventor: Titus Gadwin Watts, San Francisco, CA (US)

( * ) Notice: Subject to any disclaimer, the term of this patent is extended or adjusted under 35 U.S.C. 154(b) by 0 days.

(21) Appl. No.: 17/841,512

(22) Filed: Jun. 15, 2022

Related U.S. Application Data

(60) Provisional application No. 63/211,917, filed on Jun. 17, 2021.

(51) Int. Cl.
*F41B 5/00* (2006.01)
*F41B 5/14* (2006.01)

(52) U.S. Cl.
CPC ..... *F41B 5/0094* (2013.01); *F41B 5/1449* (2013.01)

(58) Field of Classification Search
CPC ..... F41B 5/00; F41B 5/0005; F41B 5/0031; F41B 5/0094; F41B 5/14; F41B 5/1449
USPC ..... 124/23.1, 88
See application file for complete search history.

(56) References Cited

U.S. PATENT DOCUMENTS 261,610 A * 7/1882 Howe ..... F41B 5/00 124/90
428,912 A * 5/1890 Holmes ..... F41B 5/1411 124/23.1
1,608,765 A * 11/1926 Bevier ..... F41G 1/467 124/24.1
2,316,880 A * 4/1943 Miller ..... F41B 5/0089 124/23.1
2,736,309 A * 2/1956 Hoffman ..... F41B 5/0073 124/23.1
2,945,488 A * 7/1960 Cravotta ..... F41B 5/0021 273/DIG. 7
3,038,830 A * 6/1962 Groves ..... F41B 5/0005 156/212
3,167,063 A * 1/1965 Kappas ..... F41B 5/0005 273/DIG. 7
3,552,373 A * 1/1971 Van Hecke ..... F41B 5/0094 124/22
3,595,213 A * 7/1971 Storer ..... F41B 5/0094 124/22
3,659,577 A * 5/1972 Richardson ..... F41B 5/0031 273/DIG. 7
3,674,001 A * 7/1972 Hitt ..... F41B 5/0005 273/DIG. 7
3,744,473 A * 7/1973 Nishioka ..... F41B 5/0094 124/25.6
3,802,410 A * 4/1974 Palma ..... F41B 5/0073 124/88
3,812,835 A * 5/1974 Smith ..... F41B 5/0094 124/90

(Continued)

*Primary Examiner* — Alexander R Niconovich
(74) *Attorney, Agent, or Firm* — Plager Schack LLP; Mark H. Plager; Naomi Mann

(57) ABSTRACT

An archery bow for a bow and arrow system comprises a main bow with a tensioner assembly designed to increase the pullback capacity and/or arrow firing strength of the bow. The tensioner assembly includes a first tensioner comprising an elongated bendable member made of a hard material. A middle section of the first tensioner is coupled to a main bow inner projection, wherein at least portions of the upper and lower sections of the first tensioner are offset from an inner side of the main bow, and wherein bending of the main bow causes the first tensioner to bend.

9 Claims, 4 Drawing Sheets

(56) References Cited

U.S. PATENT DOCUMENTS 3,851,638 A * 12/1974 Alexander ..... F41B 5/105 124/90
3,965,883 A * 6/1976 Meyer ..... F41B 5/0094 124/90
3,989,026 A * 11/1976 Nishioka ..... F41B 5/10 124/16
4,018,205 A * 4/1977 Meyer ..... F41B 5/0005 124/23.1
4,178,904 A * 12/1979 Meininger ..... F41B 5/0094 124/44.5
4,183,345 A * 1/1980 Caldwell ..... F41B 5/0094 124/90
4,201,182 A * 5/1980 Butler ..... F41B 5/0094 124/88
4,244,345 A * 1/1981 Simo ..... F41B 5/0094 124/16
4,287,867 A * 9/1981 Islas ..... F41B 5/0094 124/25.6
4,457,288 A * 7/1984 Ricord ..... F41B 5/10 124/900
4,530,342 A * 7/1985 Simo ..... F41B 5/10 124/88
4,644,928 A * 2/1987 Studanski ..... F41B 5/0005 124/24.1
4,712,533 A * 12/1987 Cruise ..... F41B 5/0063 273/DIG. 7
4,722,317 A * 2/1988 Hartwig ..... F41B 5/0094 124/25.6
4,733,647 A * 3/1988 Mattheck ..... F41B 5/0052 124/88
5,150,699 A * 9/1992 Boissevain ..... F41B 5/0094 124/900
5,165,382 A * 11/1992 Morrison ..... F41B 5/0073 124/88
5,353,777 A * 10/1994 Fincher ..... F41B 5/0094 124/16
5,373,831 A * 12/1994 Cushman ..... F41B 5/10 124/88
5,454,361 A * 10/1995 Bronnert ..... F41B 5/0094 124/23.1
5,706,794 A * 1/1998 Neal ..... F41B 5/10 124/23.1
5,934,264 A * 8/1999 Doornenbal ..... F41B 5/0094 124/23.1
6,029,644 A * 2/2000 Bronnert ..... F41B 5/0068 124/23.1
6,536,421 B1 * 3/2003 Jenkins ..... F41B 5/0073 124/23.1
7,740,011 B1 * 6/2010 Bernardy ..... F41B 5/0005 124/16
8,104,460 B2 * 1/2012 Ribi ..... F41B 5/10 124/25
8,196,570 B2 * 6/2012 Christensen ..... F41B 5/10 124/23.1
9,810,503 B2 * 11/2017 Serviss ..... F41B 5/1426
10,436,545 B2 * 10/2019 Pell ..... A63B 21/4043
10,627,185 B2 * 4/2020 Marriott ..... F41B 5/123
11,156,428 B1 * 10/2021 Nishihira ..... F41B 5/105
11,226,167 B2 * 1/2022 Thalberg ..... F41B 5/1403
2015/0362281 A1 * 12/2015 Derus ..... F41B 5/1403 124/88
2020/0240742 A1 * 7/2020 Marriott ..... F41B 5/12
2022/0018627 A1 * 1/2022 Marriott ..... F41B 5/00

* cited by examiner

LONG BOW WITH TENSIONERS

RELATED APPLICATION

This application claims benefit to U.S. Provisional Application No. 63/211,917 filed on Jun. 17, 2021, which is incorporated by reference herein in its entirety.

BACKGROUND

The present disclosure relates generally to archery, and in particular to a system for strengthening an archery bow.

Conventional archery bows may typically have a thin handle rise section which may limit the tension that can be placed on the bow string and overall strength of the bow when the arrow is pulled back. As such, an improved bow design that addresses at least the above-mentioned limitation is desirable.

SUMMARY

According to various embodiments, disclosed is an archery bow for a bow and arrow system comprising a tensioner assembly designed to increase the pullback capacity and/or arrow firing strength of the bow. In embodiments, the disclosed archery bow may comprise a main bow, including a main bow inner side; a main bow inner projection extending inwardly from a middle section of the inner side of the main bow; a first tensioner comprising an elongated bendable member made of a hard material, the first tensioner including a middle section, an upper section, and a lower section, wherein the middle section of the first tensioner is coupled the main bow inner projection opposite the main bow, wherein at least a portion of the upper section of the first tensioner is offset from the main bow inner side, wherein at least a portion of the lower section of the first tensioner is offset from the main bow inner side, and wherein bending of the main bow causes the first tensioner to bend.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
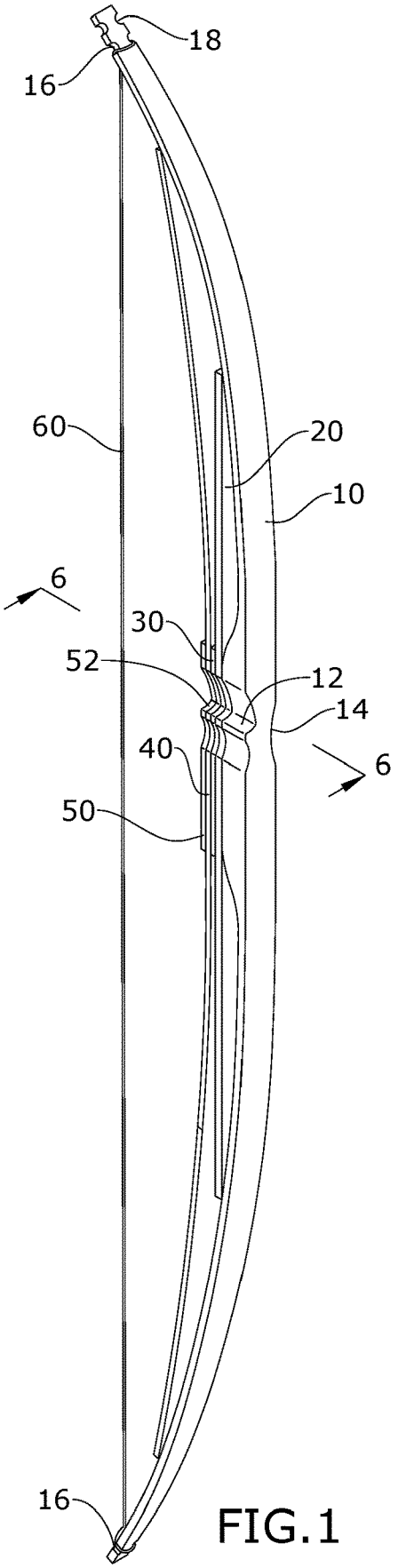
FIG. 1 is a front perspective view of a bow and arrow assembly including a tensioner assembly, in accordance with various embodiments.
Figure 2:
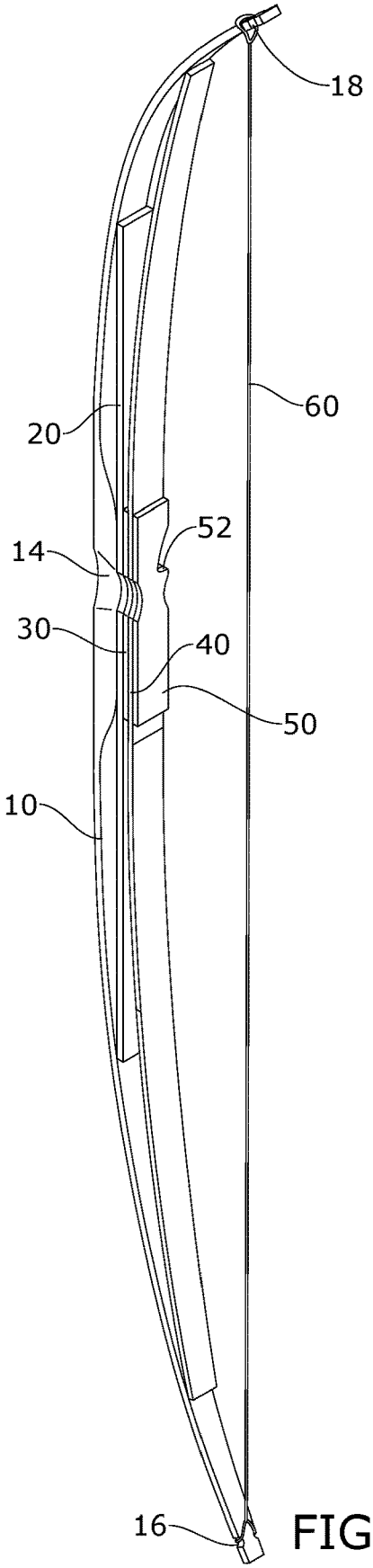
FIG. 2 is a rear perspective view thereof.
Figure 3:
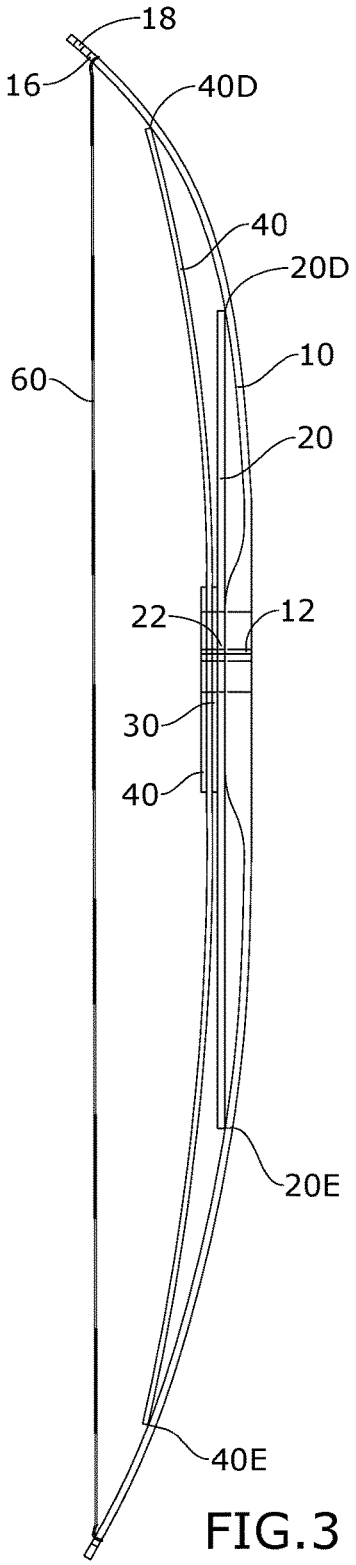
FIG. 3 is a side view thereof.
Figure 4:
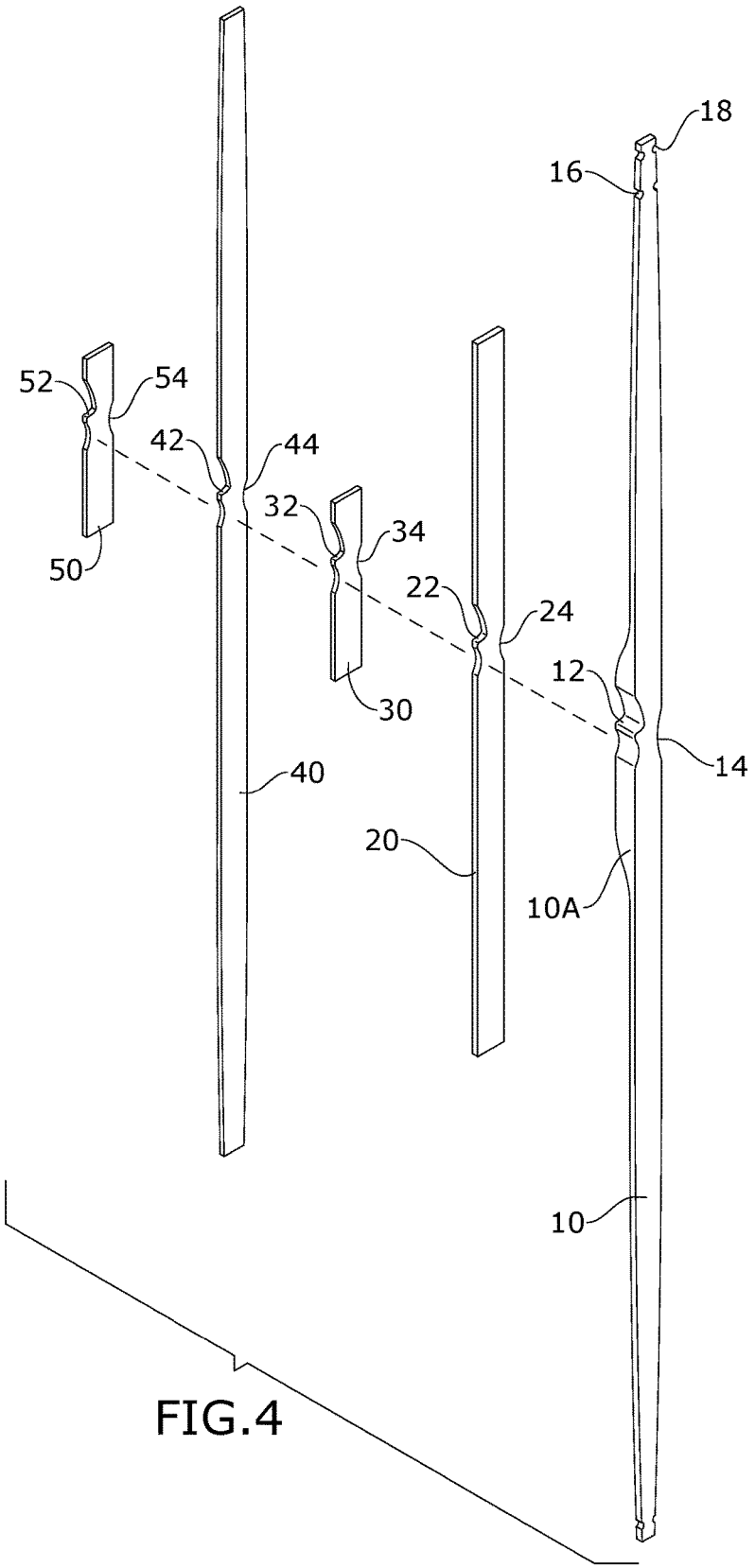
FIG. 4 is a front perspective exploded view of the bow and components of the tensioner assembly.
Figure 5:
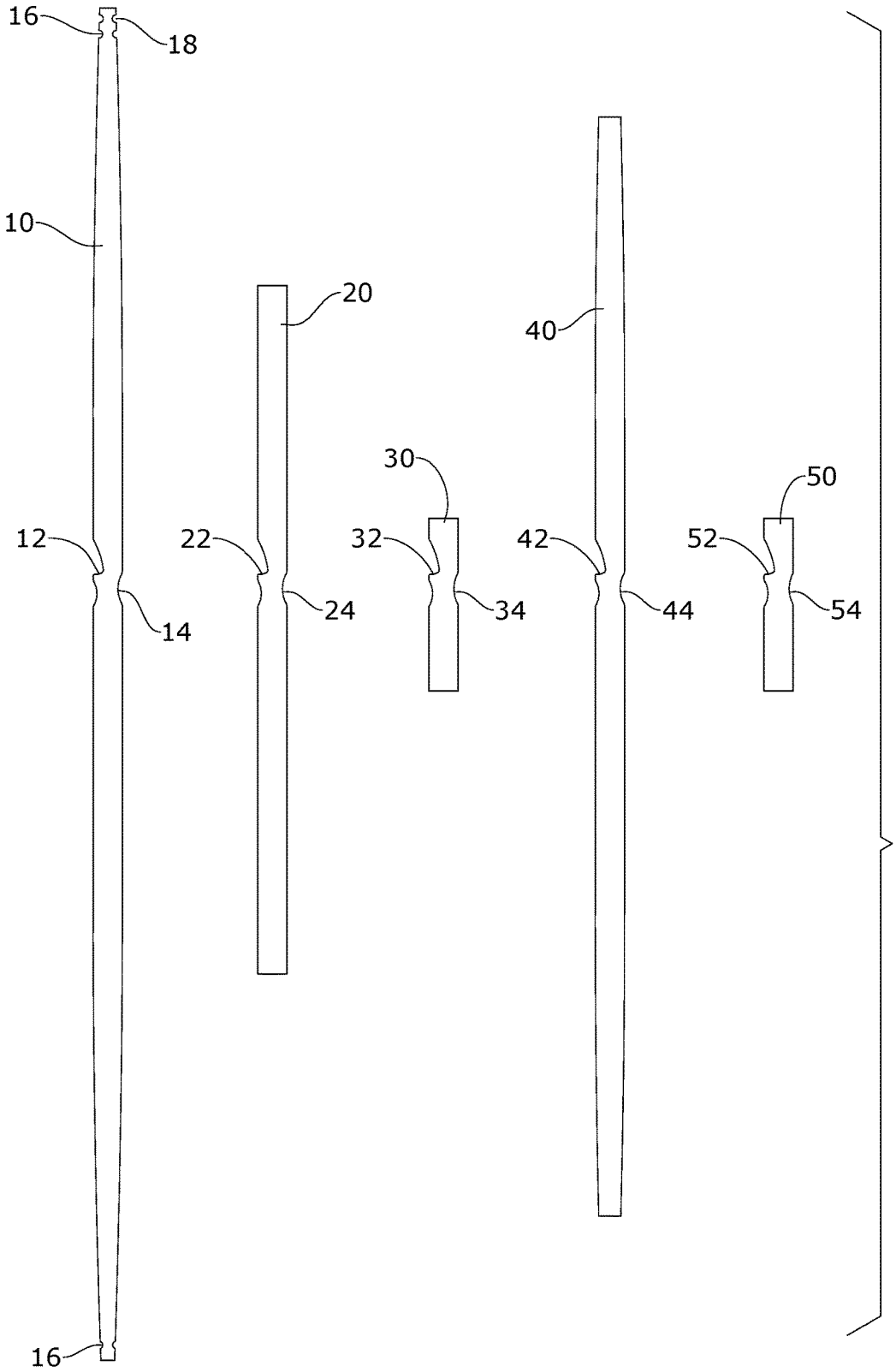
FIG. 5 is a front view of bow and components of the tensioner assembly.
Figure 6:
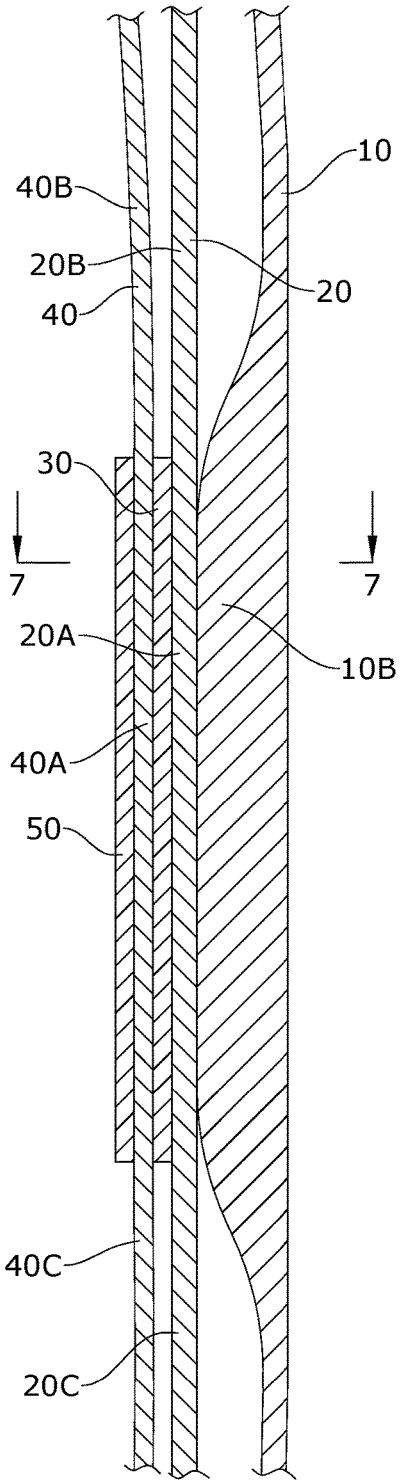
FIG. 6 is a section view taken along line 6-6 in FIG. 1.
Figure 7:
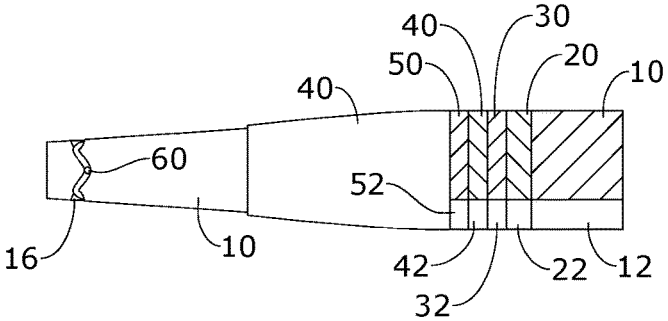
FIG. 7 is a section view taken along line 7-7 in FIG. 6.
Figure 8:
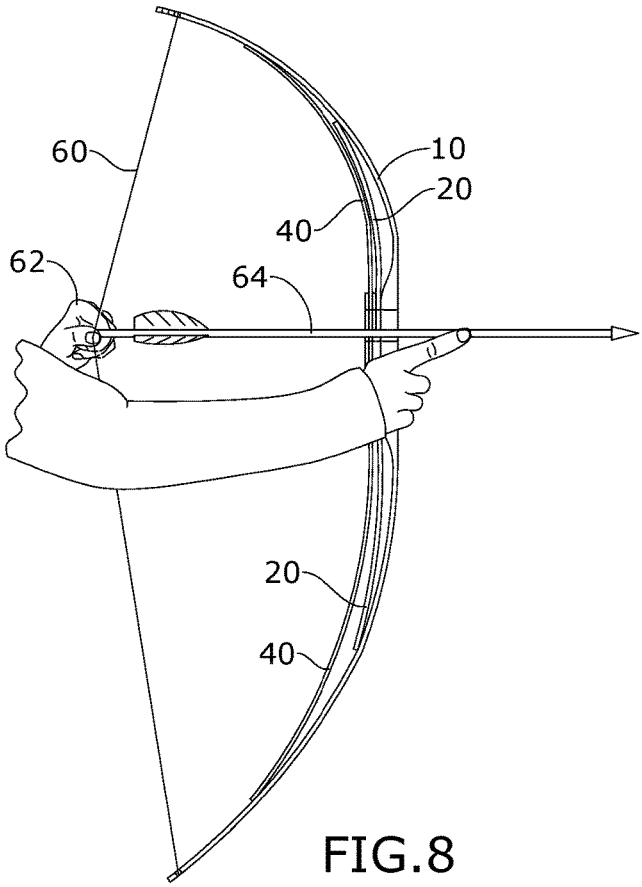
FIG. 8 is a side view of the bow, illustrating engagement of the tensioner assembly when the bow string is pulled.

According to various embodiments as depicted in FIGS. 1-8, disclosed is an archery bow for a bow and arrow system comprising a tensioner assembly designed to increase the pullback capacity and/or arrow firing strength of the bow.

Bow and arrow system may generally comprise a main bow 10, a bow string 60 with ends attached around the ends of main bow 10, and an arrow 64 configured for launching via tension produced in drawing back the bow string. In some embodiments, main bow 10 may be a longbow, but is not limited to this option. In certain embodiments, main bow 10 may include inner string notches 16 and/or outer string notches 18, configured for attachment of bow string 60. In some embodiments, main bow 10 may be provided with components such as a main bow arrow rest 12. In further embodiments, main bow 10 may include a main bow hand grip 14. In embodiments, tensioner assembly comprises one or more tensioner(s) configured for increasing bow pullback capacity and arrow launching strength of the bow and arrow system, as will be described.

In certain embodiments, the tensioner assembly may comprise a first tensioner 20 coupled to an inner side 10A of main bow 10. First tensioner 20 may be an elongated bendable member made of a hard material. In embodiments, first tensioner 20 may comprise as thin flat strip of wood, plastic, metal, and the like. In some embodiments, first tensioner 20 may comprise a single strip. However, in alternate embodiments, first tensioner 20 may comprise multiple strips glued or otherwise attached in parallel. In certain embodiments, first tensioner 20 may include a first tensioner arrow rest 22 configured to align with main bow arrow rest 12. In further embodiments, first tensioner 20 may also include a first tensioner hand grip 24 configured to align with main bow hand grip 14. In some embodiments, a middle section 20A of first tensioner 20 may be coupled to main bow 10, and at least a portion of an upper section 20B and a lower section of first tensioner 20 may be offset from the main bow, leaving a clearance space between these sections and the main bow. To this end, main bow 10 may be provided with a middle section inward projection 10B which is formed integral with the main bow, and to which middle section 20A of first tensioner 20 may be coupled as shown in the figures. In alternate embodiments, a spacer (not shown) may be attached to inner side 10A of main bow 10 to create an inward projection to which middle section 20A of first tensioner 20 may be coupled. In certain embodiments, first tensioner may be configured to situate vertically straight (unbent) when the bow is at rest (i.e., untensioned), but may bend together with the bow, upon pulling back of the bow string (which causes the curvature of main bow 10 to increase). In some embodiments, a top end 20D (and/or a section proximate the top end) and a bottom end 20E (and/or a section proximate the bottom end) of first tensioner 20 may be in contact with inner side 10A of main bow 10, as shown in the figures. However, in other embodiments, top end 20D and bottom end 20E may contact inner side 10A of main bow 10 only when the bow string is pulled back and the curvature of main bow 10 is increased. It shall be appreciated that in some embodiments, as main bow 10 is bent and its curvature is increased, top end 20D and bottom end 20E and/or sections proximate thereto may slide along inner side 10A. As such, the contact surfaces between these components may be configured for reduced friction, according to various embodiments.

In certain embodiments, the tensioner assembly may further comprise a second tensioner 40, which is similar to but longer than the first tensioner. In embodiments, second tensioner 40 may be coupled to first tensioner 20 opposite inner side 10A of main bow 10. As with first tensioner 10, second tensioner 20 may be an elongated bendable member made of a hard material. In embodiments, second tensioner 20 may comprise as thin flat strip of wood, plastic, metal, and the like. In some embodiments, second tensioner 20 may comprise a single strip. However, multiple strips may be glued together or otherwise attached in parallel in alternate embodiments. In certain embodiments, second tensioner 40 may include a second tensioner arrow rest 42 configured to align with first tensioner arrow rest 22 and main bow arrow rest 12. In further embodiments, second tensioner 40 may also include a second tensioner hand grip 44 configured to align with first tensioner hand grip 24 and main bow hand grip 14.

In some embodiments, a middle section 40A of second tensioner 40 may be coupled to first tensioner 20, and at least a portion of an upper section 40B and a lower section of second tensioner 40 may be offset from the main bow, leaving a clearance space between these sections and the main bow. To this end, a first spacer 30, may be attached to middle section of first tensioner 20 opposite main bow 10 to create an inward projection to which middle section 40A of second tensioner 40 may be coupled. In some embodiments, first spacer 30 may include first spacer arrow rest 32 configured to align with second tensioner arrow rest 42, first tensioner arrow rest 22, and main bow arrow rest 12. In further embodiments, first spacer 30 may further include a first spacer hand grip 34 configured to align with second tensioner hand grip 44, first tensioner hand grip 24, and main bow hand grip 14.

In certain embodiments, second tensioner 40 may be configured to slightly bend when the bow is at rest (i.e., untensioned), and may further bend together with the bow, upon pulling back of the bow string (causing the curvature of main bow 10 to increase). In some embodiments, a top end 40D (and/or a section proximate the top end) and a bottom end 40E (and/or a section proximate the bottom end) of second tensioner 40 may be in contact with inner side 10A of main bow 10, as shown in the figures. However, in other embodiments, top end 40D and bottom end 40E may contact inner side 10A of main bow 10 only when the bow string is pulled back and the curvature of main bow 10 is increased. It shall be appreciated that in some embodiments, as main bow 10 is bent and its curvature is increased, top end 40D and bottom end 40E and/or sections proximate thereto may slide along inner side 10A. As such, the contact surfaces between these components may be configured for reduced friction, according to various embodiments.

In certain embodiments, a second spacer 50 may further be attached to second tensioner 40 on a side opposite first spacer 30, and may be configured to hold tension on second tensioner 40 and/or to stabilize it against vibrations. Second spacer 50 may further facilitate grip of the bow. In some embodiments, second spacer 50 may include second spacer arrow rest 52 configured to align with second tensioner arrow rest 42, first spacer arrow rest 32, first tensioner arrow rest 22, and main bow arrow rest 12. In further embodiments, second spacer 50 may further include a second spacer hand grip 54 configured to align with second tensioner hand grip 44, first spacer hand grip 34, first tensioner hand grip 24, and main bow hand grip 14.

According to an exemplary embodiment, main bow 10 may be a long wooden bow, with a length of approximately 5 feet, a width of approximately 1.375 inches, and a thickness of about 0.25 inches. The inward projection 10B may be naturally carved within the bow, which may be about 6 inches long and project approximately 0.75 inches from the center of the inner side of the bow. The first and second bow tensioners 20, 40, may be a strip of wood, approximately 1.375 inches wide, by approximately 0.25 inches thick. The first tensioner may be approximately 14 inches long, and the second tensioner 40 may be approximately 3 feet long. The two spacers 50, may be pieces of wood, which are each approximately 8 inches long, and approximately 1.375 inches wide, by approximately 0.25 inches thick. Additionally, the components may be attached to one another via glue.

The disclosed subject matter provides a strengthened bow and arrow system via the tensioner assembly provided within the bow. As a user 62 pulls back arrow 64 against bow string 60 the tensioner assembly strengthens the arrow launching power of the bow and arrow system by increasing the force vector in the horizontal direction (i.e., along the arrow).

It shall be appreciated that the disclosed system can have multiple configurations in different embodiments, and may be used with a variety of different bow and arrow systems. In certain embodiments, the disclosed system may include various friction reducing elements, materials, and/or structures between the contact surfaces of the tensioners and main blow. It shall be appreciated that spacers and tensioners may comprise one or more pieces of various lengths and thicknesses. Additionally, the disclosed system may use any number of tensioners and/or spacers in various embodiments.

It shall be appreciated that the components of the bow and arrow system described in several embodiments herein may comprise any alternative known materials in the field and be of any size and/or dimensions. It shall be appreciated that the components of bow and arrow system described herein may be manufactured and assembled using any known techniques in the field. In some embodiments, the disclosed system may comprise a kit for retrofitting a bow with the disclosed tensioner assembly.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An archery bow, comprising:

a main bow, including a main bow inner side;

a main bow inner projection extending inwardly from a middle section of the inner side of the main bow;

a first tensioner comprising an elongated bendable member made of a hard material, the first tensioner including a middle section, an upper section, and a lower section, wherein the middle section of the first tensioner is coupled the main bow inner projection opposite the main bow, wherein at least a portion of the upper section of the first tensioner is offset from the main bow inner side, wherein at least a portion of the lower section of the first tensioner is offset from the main bow inner side, wherein bending of the main bow causes the first tensioner to bend;

a first spacer coupled to the middle section of the first tensioner opposite the main bow inner projection;

a second tensioner comprising an elongated bendable member made of a hard material, the second tensioner including a middle section, an upper section, and a lower section, wherein the second tensioner is longer than the first tensioner, wherein the middle section of the second tensioner is coupled to the first spacer opposite the first tensioner, wherein at least a portion of the upper section of the second tensioner is offset from the main bow inner side, wherein at least a portion of the lower section of the second tensioner is offset from the main bow inner side, and wherein bending of the main bow further causes the second tensioner to bend.

2. The archery bow of claim 1, wherein the main bow inner projection is integral with the main bow.

3. The archery bow of claim 1, wherein the main bow inner projection comprises a spacer coupled to the main bow.

4. The archery bow of claim 1, wherein a top end and a bottom end of the first tensioner are in contact with the main bow inner side.

5. The archery bow of claim 1, wherein the main bow includes a main bow arrow rest, and wherein the first tensioner includes a first tensioner arrow rest aligned with main bow arrow rest.

6. The archery bow of claim 1, wherein the main bow includes a main bow finger rest, and wherein the first tensioner includes a first tensioner finger rest aligned with main bow finger rest.

7. The archery bow of claim 1, further comprising a second spacer couple to the middle section of the second tensioner opposite the first spacer.

8. The archery bow of claim 7, wherein the first tensioner, the second tensioner, the first spacer and the second spacer each comprise a thin flat strip.

9. The archery bow of claim 7, wherein the main bow, the first tensioner, the first spacer, the second tensioner, and the second spacer each include an arrow rest and a finger rest.

* * * * *